United States Patent [19]

Cardillo

[11] Patent Number: 5,058,485

[45] Date of Patent: Oct. 22, 1991

[54] RING VALVE PUMP

[76] Inventor: Joseph S. Cardillo, 4109 Via Picaposte, Palos Verdes Estates, Calif. 90274

[21] Appl. No.: 598,829

[22] Filed: Oct. 19, 1990

Related U.S. Application Data

[63] Continuation of Ser. No. 483,330, Feb. 20, 1990, abandoned, which is a continuation of Ser. No. 372,151, Jun. 27, 1989, abandoned, which is a continuation of Ser. No. 926,664, Nov. 4, 1986, abandoned.

[51] Int. Cl.[5] ..... F01B 3/10

[52] U.S. Cl. ..... 91/485; 91/499; 417/269

[58] Field of Search ..... 91/485, 487, 499, 180; 417/269, 270

[56] References Cited

U.S. PATENT DOCUMENTS

| | | | |
|---|---|---|---|
| 2,969,810 | 1/1961 | Dudley | 91/485 |
| 3,046,950 | 7/1962 | Smith | 91/491 |
| 3,055,305 | 9/1962 | Bostwick | 417/270 |
| 3,056,357 | 10/1962 | Bohnhoff | 91/487 |
| 3,194,172 | 7/1965 | Schottler | 91/485 |
| 3,752,053 | 8/1973 | Wouters | 91/487 |
| 4,051,765 | 10/1977 | Saito | 91/482 |

FOREIGN PATENT DOCUMENTS

| | | | |
|---|---|---|---|
| 174187 | 10/1983 | Japan | 417/296 |
| 515634 | 12/1939 | United Kingdom | 91/499 |
| 975230 | 11/1964 | United Kingdom | 91/499 |
| 2097067 | 10/1982 | United Kingdom | 91/487 |
| 2166499A | 5/1986 | United Kingdom | 417/269 |

*Primary Examiner*—Leonard S. Smith
*Attorney, Agent, or Firm*—Albert L. Gabriel

[57] ABSTRACT

An eccentric ring porting system for hydraulic pumps of the type having a rotating cylinder block. The rotating cylinder block has a flat annular port face with a small cluster of regularly spaced cylinder ports in the face circularly arrayed about the axis of rotation of the cylinder block. A ring valve element has a ring seat surface held flush against the cylinder port face. The axis of the ring seat surface is eccentrically offset from the axis of rotation of the cylinder block, and the cylinder ports are uncovered inside of the inner edge of the ring seat surface for output porting of the pump and outside of the outer edge of the ring seat surface for inlet porting of the pump.

16 Claims, 5 Drawing Sheets

5
5

RING VALVE PUMP

This application is a continuation of application Ser. No. 483,330 filed Feb. 20, 1990 now abandoned which is a continuation of application Ser. No. 372,151 filed June 27, 1989, which was a continuation of Ser. No. 926,664, filed Nov. 4, 1986, now both abandoned.

BACKGROUND OF THE INVENTION

1. Field of the Invention

The present invention is in the field of hydraulic pumps, and relates particularly to the type of hydraulic pump having a rotating cylinder block and wherein inlet and output porting is accomplished by cooperation between cylinder porting in the rotating cylinder block with fixed porting in the housing, this type of hydraulic pump finding particular utility for fuel injection systems.

2. Description of the Prior Art

According to the current state of the art of hydraulic systems, most hydraulic pumps are of the rotating cylinder block type. In this type of pump, means in the body of the pump such as a swash plate is engageable with the pistons which orbit with the rotating cylinder block for moving the pistons in regular succession through positive pressure or compression strokes and negative pressure or suction strokes, with the pistons in one 180° sector of the body moving in positive pressure or compression strokes and the pistons in the other 180° sector of the body moving in negative pressure or suction strokes. Of the rotating cylinder block pumps, it is estimated that at least about 95 percent employ kidney port type inlet and output valving.

In a kidney port-type valve system, two large arcuate, kidney-shaped ports are stationary in the pump body, carried in an end housing of the pump body. One of the large kidney ports covers one 180° sector for intake, and the other covers the other 180° sector for discharge. These large stationary kidney ports are separated by lands at their ends, so that they are actually each somewhat less than 180° in extent. An annular array of small, regularly spaced cylinder kidney ports is located in a flat annular cylinder port face on the rotating cylinder block, each communicating with a respective pump cylinder. The rotating cylinder port axis and the axis of the large stationary kidney ports are coaxial, and the small cylinder ports commutate abruptly from positive pressure to negative pressure at one land, and from negative pressure to positive pressure at the other land.

The state-of-the-art kidney port-type valve employed in rotating cylinder block hydraulic pumps has a number of serious problems which are inherent in the geometry, and particularly in the coaxial alignment of the rotating cylinder ports and the large stationary kidney ports. One such inherent problem is that the large stationary kidney ports and rotating cylinder ports are required to have a relatively large radial spacing from the axis of rotation relative to the specified flow volume and pressure of the pump, which causes an undesirably high scrubbing velocity of the rotating cylinder block port face against the opposed stationary kidney port face, resulting in an undesirably large amount of wear.

Another inherent problem with the kidney port-type valving is that the long stationary kidney-shaped slots with their abrupt ends and the short intermediate lands make flat lapping of the opposed porting surfaces a problem in production, tending to result in an inaccurate face-to-face seal between the valving surfaces. The relatively large porting radius contributes to this difficulty of flat lapping in production.

The abrupt intersecting of the rotating cylinder block ports with the lands at the ends of the long stationary kidney ports also results in serious problems. There is an abrupt 180° opposing geometry of the end edges of the small rotating ports relative to the end edges of the large stationary ports, which results in very rapid opening and closing functions of the porting. This abrupt 180° opposing geometry of the ports is compounded as a problem by the undesirably large radial disposition of the ports from the axis of rotation, which results in high relative approach and departure speeds of the ports.

One such problem is that this abrupt 180° intersecting of the rotating cylinder port edges with the large kidney port lands has a tendency to cause grooving in one or both of the valving surfaces, with consequent hydraulic fluid leakage from between the valving surface interface.

The positive and negative pumping functions of the rotating cylinder block pump, where the pistons are swash plate actuated, are essentially sine functions, with zero pumping at the lands, and with full positive or pressure pumping proximate the center of one of the large stationary kidney ports and full negative or suction pumping proximate the center of the other large stationary kidney port. The abrupt exposure of essentially zero pressure cylinder ports to full high pressure output and full negative pressure input of the pump inherently introduces undesirable pressure irregularities or "hydraulic ripple" into both the output and the input, and input irregularities will be reflected as further irregularities in the output.

Inaccuracies in the flatness of the opposed valving surfaces of kidney port-type rotating cylinder block pumps resulting from manufacturing difficulties and from wear such as grooving tend to cause leak paths in the axial direction normal to the general planes of the valving surfaces, while the relatively large perimeter of the kidney port valving surfaces required for the specified flow volume and pressure of the pump are cumulative factors which tend to result in a relatively large fluid escape path in the radial direction, or parallel to the general planes of the valving surfaces. A serious consequence of these leakage factors is that they result in a relatively slow build-up of pump output pressure at low pump speeds. Since fuel injector pumps are engine driven, this can be a critical deficiency at engine starting speeds, with engine starting being totally dependent upon pump pressure build-up.

SUMMARY OF THE INVENTION

In view of these and other problems in the art, it is a general object of the present invention to provide a novel valve port system for a rotating cylinder block-type hydraulic pump which has a much tighter seal over a long working life than the kidney port-type valving conventionally employed in such pumps.

Another object of the invention is to provide a valve port system for a rotating cylinder block-type hydraulic pump which embodies a novel ring-shaped valve seat surface which is eccentrically located relative to the axis of rotation of the rotating cylinder block.

Another object of the invention is to provide a novel eccentric ring valve configuration for a rotary cylinder block-type hydraulic pump which has an uninterrupted symmetrical geometry which lends itself particularly well to flat lapping in production for provision of an efficient face-to-face seal of the valve port surfaces.

A further object of the invention is to provide a ring valve porting system of the character described for a rotating cylinder-type hydraulic pump wherein the rotating cylinder port surface and cylinder ports have narrow, acute angles of attack and departure relative to the novel eccentric ring valve element of the invention, minimizing wear during operation and avoiding any tendency for grooving and consequent leakage, and causing a continuous self-cleaning action and micro-surface lapping during operation.

A still further object of the invention is to provide a novel eccentric ring valve porting system for rotary cylinder block-type hydraulic pumps wherein the geometry of the arcuate ring seat output and inlet porting edges and rotating annular cluster of cylinder ports enables the ring seat and cylinder port valving surfaces to be much smaller in area than the valving surfaces of a conventional kidney port-type valve system for a comparable pumping flow volume and pressure, such smaller area not only minimizing leakage because of the much smaller valving surface perimeter, but also enabling more accurate mating flatness of the valving surfaces to be manufactured and maintained.

Yet a further object of the invention is to provide an eccentric ring valve porting system for rotary cylinder block-type hydraulic pumps wherein the valving surface accuracy and relatively small dimension for the hydraulic fluid flow volume and pressure enable hydraulic fluid leakage from between the mating valving surfaces to be so greatly minimized that pump output pressure builds up rapidly at very low pump speeds, which is a critical advantage where the valving system of the invention is employed in fuel injector pumps which are engine driven, and where engine starting is totally dependent upon pump pressure build-up at low engine speeds.

A still further object of the invention is to provide a novel eccentric ring valve porting system for rotary cylinder block hydraulic pumps in which the rotating cylinder port openings and closings at the arcuate ring valve seat output and inlet stationary port edges are gradual and not abrupt as in the kidney port-type valve conventionally employed in such hydraulic pumps, and wherein the valve porting characteristics generally follow the pumping characteristics, whereby output pressure irregularities or hydraulic ripple are minimized.

In a rotating cylinder block-type hydraulic pump, the pistons and cylinders orbit through a first 180° sector of the body of the pump in which the pistons move in compression or output strokes and a second 180° sector of the body in which the pistons move in suction or input strokes. According to the invention, the cylinder block is provided with a cylinder port face which is generally radially oriented relative to the axis of rotation of the cylinder block, with a circular array of regularly spaced cylinder ports opening at the cylinder port face, each of which ports is in communication with a respective one of the cylinders. A generally ring-shaped valve element has an annular ring seat surface which is in face-to-face engagement with the cylinder port face, with the axis of the ring seat surface eccentrically offset relative to the axis of rotation of the cylinder block and cylinder ports. This eccentric offset of the ring seat axis is preferably toward the compression or output 180° sector of the body of the pump, causing the compression or output cylinders to be exposed inside the inner edge of the ring seat surface for positive pressure output porting of the pumped hydraulic fluid, and the suction or input cylinders to be exposed outside the outer edge of the ring seat surface for negative pressure or suction input porting of the fluid from a hydraulic fluid source. Output fluid pressure is applied to the ring valve element to hold the ring valve seat surface down against the cylinder port face so as to more than counterbalance the lift-off force of hydraulic fluid which works into the interface between the cylinder port face and the valve seat surface, and start-up spring biasing is also applied to the ring valve element for biasing the porting surfaces together until the output fluid pressure builds up accomplish this function.

BRIEF DESCRIPTION OF THE DRAWINGS

These and other objects of the invention will become more apparent in view of the following description taken in conjunction with the drawings, wherein.

DETAILED DESCRIPTION

Figure 1:
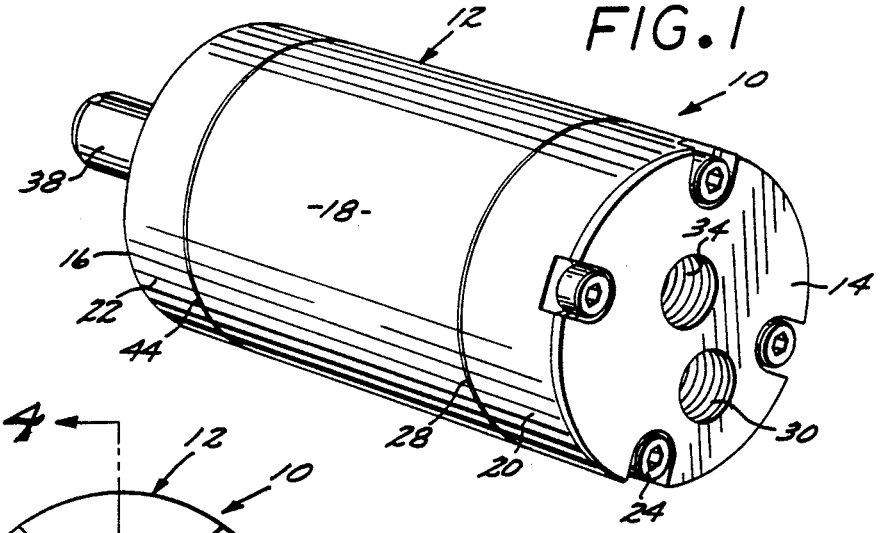
FIG. 1 is a perspective view of a ring valve pump embodying the present invention.

Referring to the drawings, and at first particularly to FIGS. 1 to 4 thereof, the ring valve pump of the present invention is generally designated 10 and is encased in a generally cylindrical body 12 having ends 14 and 16. The body 12 consists of a cylindrical case 18, a valve end housing 20 secured to one end of case 18, and a shaft end housing 22 secured to the other end of case 18. Valve end housing 20 contains the ring valve element of the invention which cooperates eccentrically with annularly arrayed cylinder porting of the pump to define the inlet and output flow paths of the invention. Shaft end housing 22, on the other hand, has the pump shaft coaxially supported therein with the driven end of the pump shaft projecting outwardly therethrough.

Valve end housing 20 is attached to one end of cylindrical case 18 by means of an annular series of regularly spaced bolts 24, being positively located relative to case 18 by an annular series of regularly spaced locating pins 26. An annular gasket 28 seals the interface between valve end housing 20 and cylindrical case 18.

Figure 2:
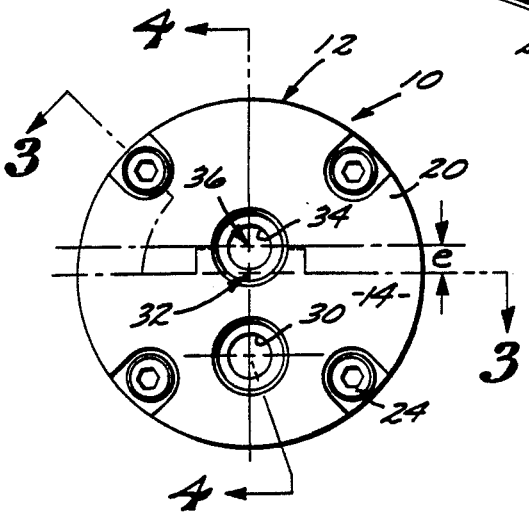
FIG. 2 is an end elevational view of the ring valve pump of the invention looking toward the valve end housing.
Figure 4:
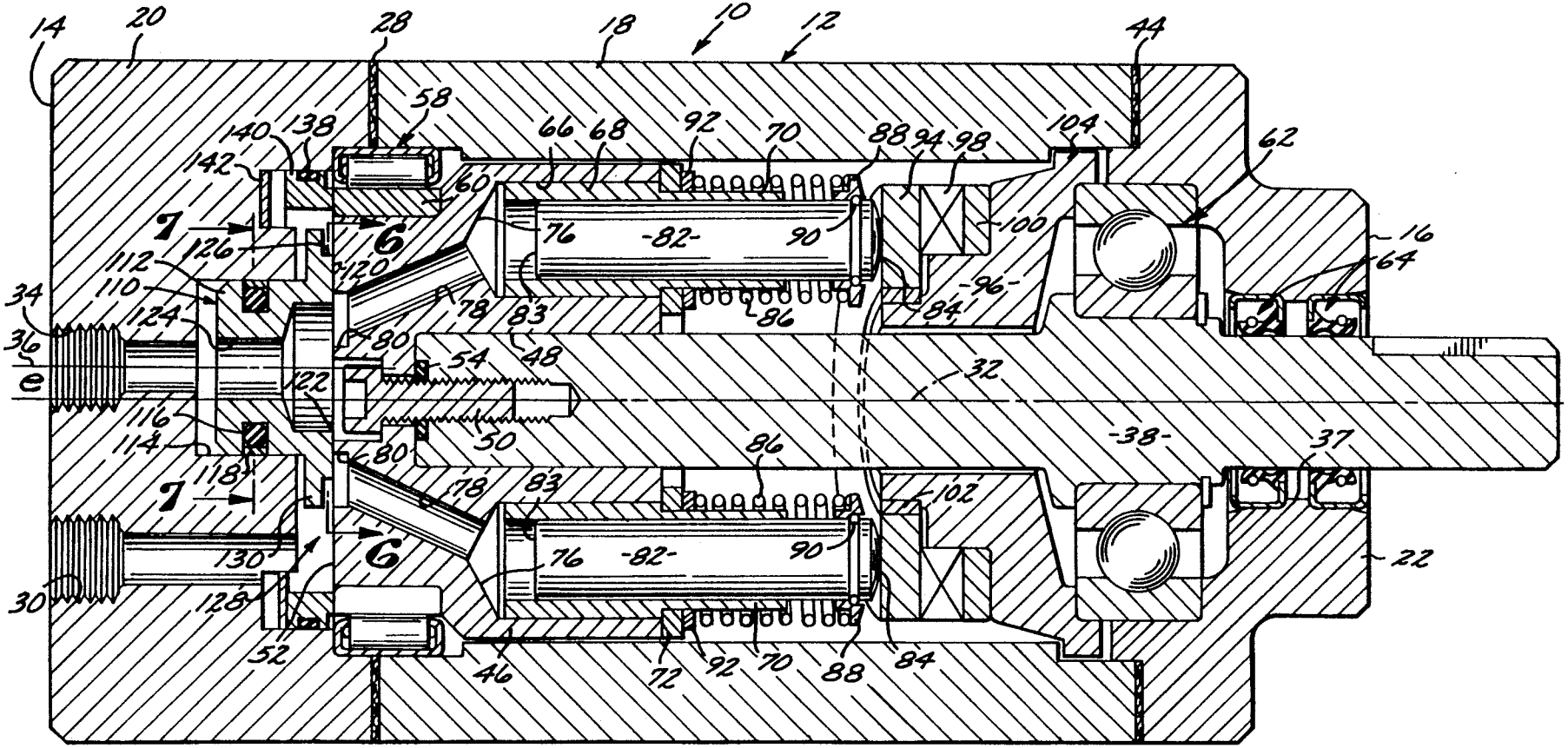
FIG. 4 is an axial sectional view taken on the line 4—4 in FIG. 2, this section coinciding with both the axis of rotation of the rotating cylinder block and the axis of the ring valve element of the invention.

As seen in FIGS. 1, 2 and 4, fluid inlet passage 30 extends through valve end housing 20 parallel to but considerably radially offset from the center axis 32 of pump 10, opening out at the valve end 14 of body 12 for connection to and communication with a fluid source of supply. Output passage 34 also extends partly through valve end housing 20, opening out at the valve end 14 of body 12 for connection to and communication with apparatus receiving the pressurized liquid from ring valve pump 10, such as diesel or gasoline fuel injector apparatus. As best illustrated in FIGS. 2 and 4, output passage 34 is aligned with the eccentric axis 36 of the ring valve element of the invention. The eccentric axis 36 is parallel to the center axis 32 of pump 10, but is radially offset from center axis 32 an eccentric amount designated "e" in FIGS. 2, 4 and 6 which enables the novel inlet and output porting of the invention to be accomplished between the stationary ring valve element and the rotating cylinder block porting as described in detail hereinafter.

Shaft end housing 22 has an axial passage 37 through which the outer, driven end portion of pump shaft 38 extends. Shaft end housing 22 is connected to cylindrical case 18 by means of a series of regularly spaced bolts 40, being positively located relative to case 18 by a series of regularly spaced locating pins 42. The interface between case 18 and shaft end housing 22 is sealed by a gasket 44.

A generally annular cylinder block 46 is mounted on the inner end portion of pump shaft 38, being provided with a central bore 48 which receives the inner end portion of shaft 38. Cylinder block 46 is secured to shaft 38 by means of a coaxial screw 50 which has its head recessed relative to a flat annular port face 52 on cylinder bock 46. An O-ring seal 54 between the inner end of shaft 38 and cylinder block 48 provides a fluid-tight seal therebetween. Shaft 38 is a drive shaft for rotating the cylinder block 46, and is accordingly keyed to cylinder block 46 by means of elongated key 56 which is engaged in registering slots in shaft 38 and cylinder block 46.

The port end portion of cylinder block 46 is journalled in a needle bearing assembly 58 located partly within case 18 and partly within the periphery of valve end housing 20. Needle bearing assembly 58 has an inner bearing race 60 secured to cylinder block 46. Rotational support for shaft 38 and cylinder block 46 is completed by means of a ball bearing assembly 62 mounted within shaft end housing 22. A pair of shaft seals 64 of the lip seal type is mounted in shaft end housing passage 37, and the space between seals 64 is vented to the outside of pump body 12 by a passage 65 to prevent pressure buildup between the seals.

An annular series of cylinder bores 66, each carrying a cylinder sleeve 68, is regularly spaced around cylinder block 46. Cylinder bores 66 and sleeves 68 are parallel to and equally radially spaced from the center axis 32 of pump 10. In the embodiment of the invention illustrated in the drawings, there are seven of the cylinder bores 66 and sleeves 68. Cylinder sleeves 68 have reduced outer portions which extend out of cylinder bores 66 toward the shaft end 16 of body 12, these reduced outer portions 70 extending through complementary passages in a retainer plate 72 which is secured to the shaft end surface of cylinder block 46 by means of a series of regularly spaced screws 74, so as to retain cylinder sleeves 68 in cylinder block 46.

The inner or head ends 76 of the cylinders are cupped for clearance, by conical recesses in the form shown, and cylinder ends 76 communicate through respective cylinder head flow passages 78 to respective cylinder head ports 80 in the port face 52 of cylinder block 46. Cylinder head flow passages 78 incline axially and radially inwardly from head ends 76 of the cylinders to cylinder head ports 80 to achieve the very small radial distance of cylinder head ports 80 from the center axis 32 which is an important aspect of the invention, while nevertheless enabling the cylinders to be relatively widely radially spaced outwardly from the center axis 32 to provide the required amount of space for the cylinders, pistons, and piston accuating mechanism to be described in detail below. Cylinder head ports 80 are round counterbores at the port ends of inclined flow passages 78.

A piston 82 is slideably mounted in each of the cylinder sleeves 68, pistons 82 being reciprocally driven as cam followers as they orbit about the center axis 32 during rotation of cylinder block 46. Pistons 82 have inner fluid actuating ends 83 and outer cam follower ends 84. Outer cam follower piston ends 84 may be of generally spherical configuration as shown, or alternatively, may be of a modified cone configuration with the general cone angle approximating the cam angle of inclination relative to axis 32 of pump 10. Each of the pistons 82 is biased outwardly relative to its cylinder sleeve 68 by a helical piston spring 86 engaged over the reduced outer portion 70 of the respective cylinder sleeve 68. The piston spring biasing is applied by each spring 86 to a respective spring guide 88 and thence through a respective guide retaining ring 90 to the respective piston 82 near its outer end 84. The inner end of each piston spring 86 bears against a respective spacer washer 92 which in turn bears against the retainer plate 72.

Outer cam follower ends 84 of pistons 82 are driven, by rotation of the cylinder block 46, against a cam swash plate 94 which is located at a fixed position within pump body 12 by means of a cam plate structure 96. Cam swash plate 94 is in the form of a ring which is freely rotatably backed against a ring-shaped roller bearing assembly 98 which in turn bears against a thrust washer 100, both bearing assembly 98 and thrust washer 100 being located on cam plate structure 96. An annular bushing 102 concentrically locates swash plate 94 around its axis of rotation, which is designated 103 in FIG. 3. The force of piston springs 86 biases swash plate 94, bearing assembly 98 and thrust washer 100 together against cam plate structure 96. Cam plate structure 96 is held in its geometrically fixed location within pump body 12 by the annular end portion 104 of cam plate structure 96 bearing against and overlapping the outer race of ball bearing assembly 62 and by being pinned against rotational movement by pins 105 in shaft end housing 22. Thus, the axis 103 of cam swash plate 94 has a fixed angle of inclination 106 relative to center axis 32 of pump 10 in the plane of the FIG. 3 section, and this is 90° from the plane of the FIG. 4 section or from the direction of the ring valve element eccentricity "e" illustrated in FIGS. 2, 4 and 6. The angle of inclination 106 of swash plate axis 103 provides a second eccentricity in the ring valve pump 10 of the invention, which cooperates with the porting eccentricity "e" in a new way described in detail below.

A fluid access port 107 is provided through the wall of case 18 enabling the interior of pump body 12 to be filled with the liquid being pumped, or emptied if desired, and access port 107 will be plugged during operation of ring valve pump 10. The end portion of shaft 38 which projects outwardly from end housing 22 is provided with a drive key slot 108.

The ring valve element of the invention is generally designated 110, and it is mounted within valve end housing 20 so as to butt face-to-face against the flat annular port face 52 of cylinder block 46. Ring valve element 110 has a cylindrical body 112 which fits within a generally complementary but somewhat longer cylindrical recess 114 in valve end housing 20. An O-ring seal 116 and slipper ring 118 are seated within an annular groove in cylindrical body 112 to provide a generally fluid-tight seal between body 112 of valve element 110 and the cylindrical surface of recess 114 in end housing 20.

The valving surface of ring valve element 110 is flat annular ring seat surface 120 which bears flush against cylinder block port face 52 and is defined between inner and outer cylindrical surfaces of valve element body 112. The inner edge 122 of ring seat surface 120 defines the fixed or nonrotating output port of the valve, and this in turn communicates through an output conduit 124 extending axially through valve element 110 to the cylindrical recess 114 and thence to output passage 34 of ring valve pump 10.

Annular outer periphery 126 of ring seat surface 120 defines the fixed or nonrotating inlet port of the valve. The inner end of valve end housing 20 is annularly recessed to provide valve inlet chamber 128 which surrounds the inner, porting end of ring valve element 110. An annular locating flange 130 projects peripherally from ring valve element 110 within inlet chamber 128, and an annular series of regularly spaced locating pins 132 keys locating flange 130, and hence valve element 110, against rotation relative to valve end housing 20. Pins 132 are fixed to valve end housing 20, but have an axially sliding fit in complementary holes in valve element locating flange 130 to permit axial adjustment of valve element 110 to an optimal seated position against cylinder block port face 52.

An annular series of helical springs 134 is mounted in respective regularly spaced recesses 136 in valve end housing 20, springs 134 bearing against flange 130 on valve element 110 so as to bias the valve element ring seat surface 120 generally flush against cylinder block port face 52. Springs 134 are only required for start-up biasing to hold the porting surfaces 120 and 52 together until substantial fluid output pressure has been developed by the pump, after which fluid output pressure itself provides the desired biasing force as described in detail below.

Inlet chamber 128 is isolated from cylinder block needle bearing assembly 58 by means of an O-ring seal 138 mounted in an annular retainer 140 which is biased against needle bearing race 60 by means of a wave or marcel spring 142.

Pump Operation

There are two separate eccentricities embodied in the present invention which are cooperatively arranged so as to substantially completely avoid irregularity or "ripple" in the pressurized output flow from the ring valve and rotary cylinder block combination of the present invention. One of these eccentricities is the angular axial offset 106 of the swash plate axis 103 relative to the center axis 32 of pump 10. The other eccentricity is the eccentricity "e" of the ring valve element axis 36 relative to the center or primary axis 32 of the pump, which is the axis about which pump cylinder block 46 and cylinder valve ports 80 rotate. These two axes of eccentricity are cooperatively related in a wholely new way in the present invention to substantially completely avoid flow irregularities or hydraulic ripple in the output of ring valve pump 10. This can be important for the typical use of the invention as a fuel injector pump, particularly where pressures may be very high, as in some diesel fuel injector systems wherein the pressure may typically be on the order of 2,000 to 5,000 psig, and in a new extremely short duration diesel fuel injector system of which applicant is aware up to as much as about 15,000 psig.

Figure 5:
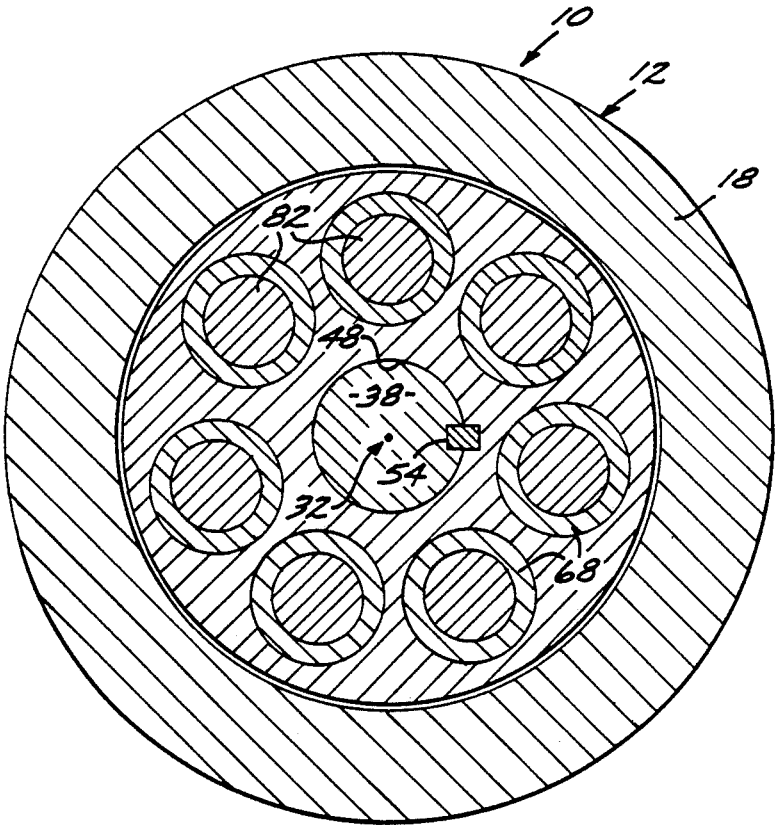
FIG. 5 is a cross-sectional view taken on the line 5—5 in FIG. 3.
Figure 6:
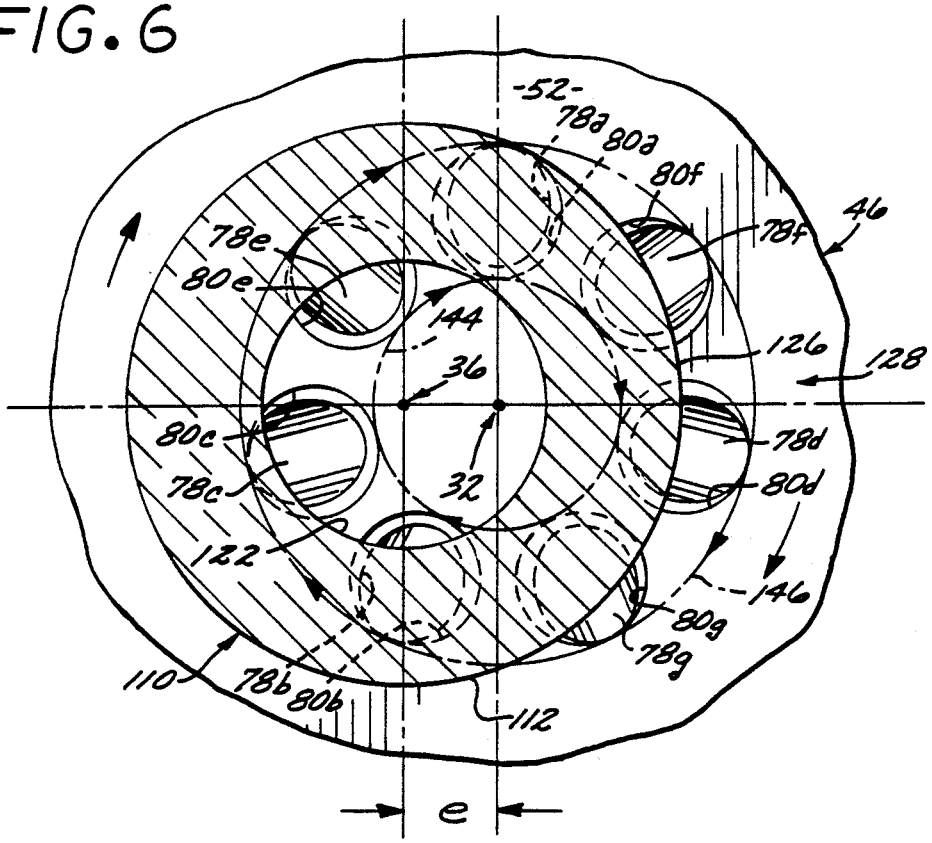
FIGS. 6 and 6A are enlarged, fragmentary transverse sectional views taken on the line 6—6 in FIG. 4.

The eccentric angle of inclination 106 of axis 103 of swash plate 94 produces the pumping action of pistons 82 in response to rotation of cylinder block 46 and consequent orbiting of the cylinders 66 and pistons 82. With the direction of offset of eccentricity "e" of ring valve element eccentric axis 36 relative to center axis 32, and the direction of inclination 106 of cam swash plate axis 103 relative to center axis 32, cylinder block 46 will rotate clockwise as illustrated in FIGS. 5 and 6, and the upper cylinder as viewed in each of FIGS. 3 and 4 will be moving upwardly out of the sheet, while the lower cylinder in each of FIGS. 3 and 4 will be moving downwardly into the sheet. This direction of rotation is illustrated by phantom arrows in FIG. 6.

Figure 3:
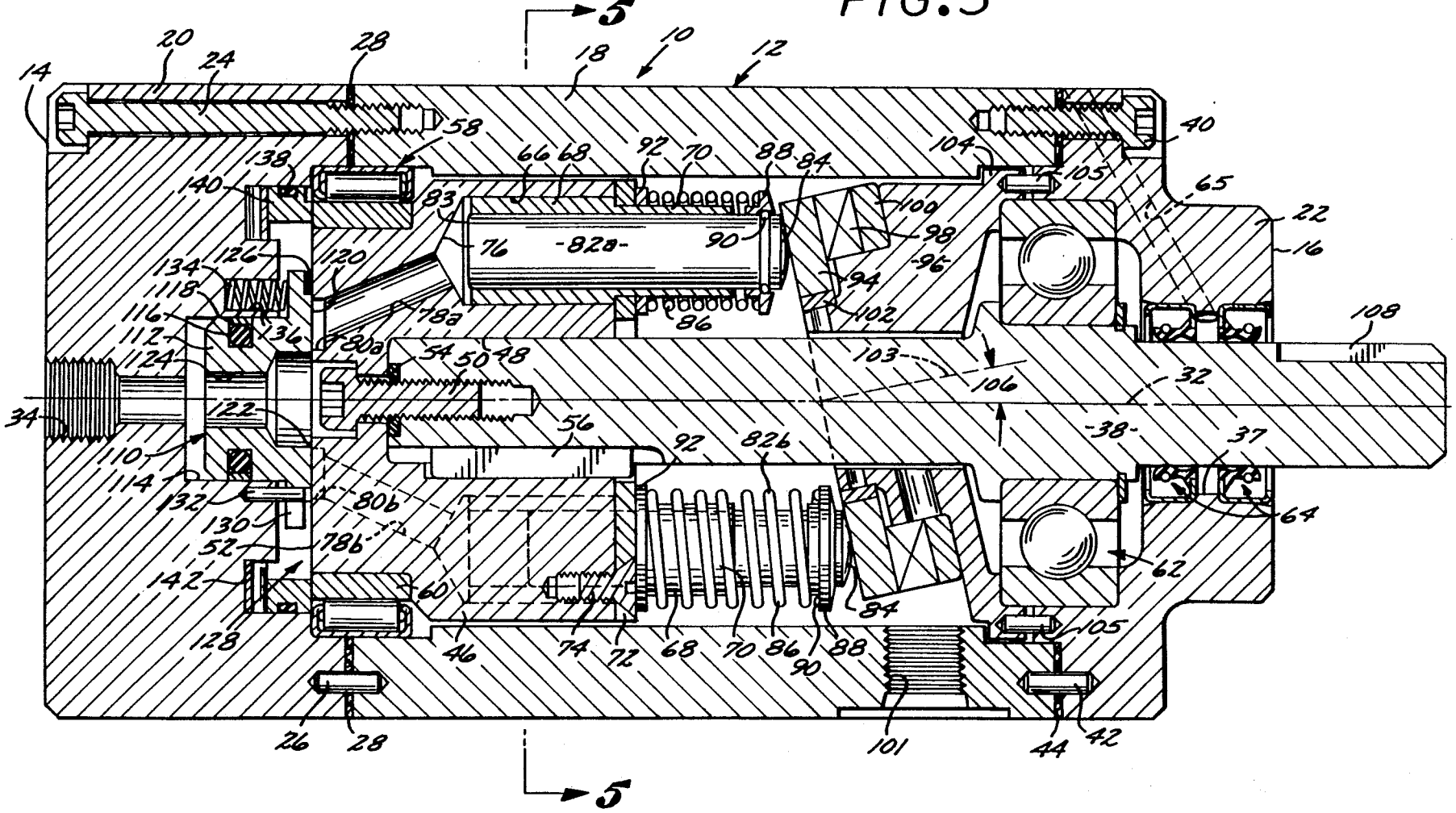
FIG. 3 is an axial section taken on the line 3—3 in FIG. 2, with the section being taken through the axis of rotation of the rotating cylinder block of the pump, and then eccentrically offset so as to also be taken through the axis of the ring valve element of the invention.

As rotating cylinder block 46 orbits pistons 82 about center axis 32, inclined swash plate 94 and piston springs 86 cooperate to move the pistons between fully recessed and fully extended positions in their respective cylinders 66. As viewed in FIG. 3, the upper piston **82*a* is in the fully recessed position, and the lower piston 82*b* is close to its fully extended position. As cylinder block 46 rotates through the first 180° from the position illustrated in FIG. 3, piston 82*a*, operating as a cam follower relative to swash plate cam 94, shifts outwardly in a suction stroke from its fully recessed position of FIG. 3 to a fully extended position corresponding approximately to the position of piston 82*b* in FIG. 3. Conversely, during this first 180° of rotation from the position illustrated in FIG. 3, piston 82*b* will be shifted in a compression stroke from proximate its fully extended position as illustrated in FIG. 3 to a fully recessed position corresponding approximately to the position of piston 82*a* in FIG. 3. Then, during the next 180° of rotation of cylinder block 46, piston 82*a* will move back forwardly in a compression stroke to its fully recessed position as shown in FIG. 3, while piston 82*b* will move back rearwardly in a suction stroke to its fully extended position as illustrated in FIG. 3**.

As viewed in FIG. 4, cylinder block 46 has a 90° rotational lead relative to where it is in FIG. 3, so the pistons **82*c* and 82*d* seen in FIG. 4 are close to the middle of their axial travels, and hence close to having their highest movement speeds. The upper piston 82*c* in FIG. 4 is close to the middle of its suction stroke, while the lower piston 82*d* in FIG. 4** is close to the middle of its compression stroke.

Thus, the body 12 of pump 10 may be considered as having two 180° sectors through which the cylinders 66, pistons 82, and cylinder ports 80 orbit, a 180° compression sector which is the sector of body 12 shown in FIG. 3 and the lower half of body 12 as viewed in FIG. 4, and a 180° suction sector which is the sector of body 12 out of the page in FIG. 3 and the upper half of body 12 as viewed in FIG. 4.

The axially oriented compression and suction strokes of pistons 82 follow a sinusoidal path around the general cylinder of orbiting of the pistons around axis 32, piston movement slowing down to essentially zero proximate the fully recessed and fully extended positions of the pistons where the apices of the sine curve are traced;

and having their most rapid axial movement proximate the midpoints of their strokes corresponding to the steepest slope of the sine curve representing their movements. The novel eccentric ring valve porting of the invention produces valve port inlet and output apertures which vary in cross-sectional dimension surprisingly closely with the sine curve movement pattern of the pistons 82 in synchronism with the piston movements to substantially completely eliminate flow irregularities or hydraulic ripple, as described in detail below.

The rolling action of swash plate bearing assembly 98 results in a minimal amount of friction between the freely rotating swash plate and the piston cam follower ends 84, with the spherical or modified conical configuration of the ends 84. As the piston ends 84 orbit against swash plate 94, the swash plate surface engages piston heads 84 in an orbiting engagement path, called a smear path, on the swash plate surface, and although pistons 82 are free to rotate in their respective cylinders, they only slightly oscillate or nutate in the cylinder bores.

The Eccentric Ring Valve Porting

The cooperative porting between ring seat surface 120 of ring valve element 110 and cylinder port face 52 is best illustrated in FIG. 6. FIG. 6 illustrates how cylinder ports 80, which communicate with respective cylinders 66 through respective cylinder head flow passages 78, are commutated relative to the eccentric ring seat surface 120, and hence relative to inner output port periphery 122 and outer inlet port periphery 126 of ring seat surface 120.

Considering that cylinder block 46 is rotating clockwise as viewed in FIG. 6, cylinder port 80*a*, which communicates through flow passage 78*a* to the cylinder containing piston 82*a*, is at its location of greatest closure and is about to become uncovered at its outer edge radially outwardly of the outer periphery or inlet port 126 of ring seat surface 120 so as to be exposed to inlet chamber 128. On the other side of ring seat surface 120, cylinder port 80*b*, which communicates through passage 78*b* to the cylinder containing piston 82*b*, has already become partly uncovered inwardly of the inner periphery or output port 122 of ring seat surface 120 so as to communicate with output conduit 124. Cylinder port 80*c*, which is the next port ahead of 80*b*, and communicates with the respective cylinder through flow passage 78*c*, is exposed almost to its fullest extent inwardly of ring output port 122. The next cylinder port 80*e*, which is ahead of port 80*c* but behind port 80*a*, has moved well past its location of greatest opening inside ring output port 122, and is now moving toward its closed position.

On the other side of ring seat surface 120, to the right as viewed in FIG. 6, port 80*f* is approximately one-half opened outwardly of outer periphery 126 of seat 120 for communication with inlet chamber 128, and is moving toward its fully opened position. Cylinder port 80*d* has moved slightly past its most fully opened position outside of outer periphery 126 of ring seat 120, and is still close to its fully opened position for communication with inlet chamber 128. Cylinder port 80*g* has moved well past its fully opened position and is now moving toward its closed position inside of outer periphery 126 of ring seat 120.

It will thus be seen that ring seat surface 120 of ring valve element 110 performs the identification of cylinder ports 80 during commutation of cylinder ports 80 caused by rotation of cylinder block 46, the inner periphery 122 of ring seat 120 identifying the cylinder ports 80 for communication to output conduit 124 when their respective pistons are in compression mode, and the outer periphery 126 of ring seat surface 120 identifying the cylinder ports 80 whose pistons are in suction mode for communication with inlet chamber 128.

Inner and outer phantom circles 144 and 146 have been drawn about center axis 32 in FIG. 6 to indicate the respective inner and outer edges of cylinder ports 80. Inner circle 144 indicates the directions of movement of the inner edges and inner portions of ports 80 as they approach the inner edge 122 of ring seat 120 during opening and closing of their output phase of movement, and also during the main portion of the output phase. During the opening of ports 80 proximate the bottom of inner ring seat periphery 122 as viewed in FIG. 6, the upper edges of ports 80 move into their open positions at an acute angle relative to inner seat edge 122, and then only the upper peripheral edge portions of ports 80 are first opened at such acute angle. Similarly, as ports 80 close against the upper part of inner seat edge 122, they also move at an acute angle relative to edge 122, and only small lower peripheral edge portions of ports 80 are being closed off. In contrast, most of the lengths of the left-hand sides of inner circle 144 and inner seat edge 122 are generally parallel to each other in an offset tangential relationship, so that during that portion of the output phase of the valve porting in which large areas of cylinder ports 80 are exposed inside of ring seat edge 122, the opening and closing changes in the exposure of ports 80 within inner seat edge 122 are relatively slowly accomplished. By this means the exposure of ports 80 from opening proximate the bottom of inner seat edge 122 through the main part of output porting and finally closing proximate the upper edge of output seat edge 122 very closely follows the sinusoidal movements of the pistons and hence corresponding sinusoidal rate of flow change of the fluid flow received by cylinder ports 80 from their respective cylinders. This correlation between output port exposure and output fluid flow to the ports substantially completely eliminates output flow pressure irregularities or hydraulic ripple.

In similar fashion, the outer edges of cylinder ports 80 move at an acute angle indicated by outer circle 146 relative to outer periphery 126 of ring seat 120, both in their opening and closing movements, and only small outer sections of ports 80 are exposed proximate the opening and closing positions; while during the main or center part of the suction phase, large outer portions of ports 80 are exposed between portions of outer circle 146 and outer seat edge 126 which are generally parallel to a tangential relationship, and thereby vary only relatively slowly in their amount of exposure. Thus, exposure of cylinder ports 80 to inlet chamber 128 during the suction phase relatively closely follows the sinusoidal suction movements of the respective pistons to substantially completely eliminate input fluid surges or hydraulic ripple.

In contrast to this matching of the porting function to the pumping function achieved in the present invention, in the conventional kidney valve, the cylinder ports are uncovered and covered rapidly at full circumferential speed of the cylinder block, rapidly fully opening into the large stationary kidney ports, remaining fully opened through the entire extent of the sweep in communication with the large kidney ports, and then rapidly closing when reaching the ends of the large kidney ports. Such sudden porting and consequent sudden exposure of the high pressure, high volume output to low pressure, low volume pump port flow leads to substantial irregularity or hydraulic ripple in the output.

In the embodiment of the present invention illustrated in the drawings, there are seven of the cylinders 66, cylinder flow passages 78, cylinder ports 80, and pistons 82 regularly annularly spaced about cylinder block 46. As seen in FIG. 6, with seven of these cylinder pumping units and ports, two of the cylinder ports 80 will at all times be widely exposed to output conduit 124 inside of output port periphery 122, with a third partially exposed; while there will be two of the cylinder ports 80 widely exposed to inlet chamber 128 outside of the inlet port periphery 126, with one more partially exposed. It has been found experimentally that seven of the cylinders, pistons, and regularly annularly spaced cylinder ports 80 is a sufficient number in cooperation with ring valve seat surface 120 to smoothly provide the variable porting characteristics which generally coincide with the pumping characteristics as described in detail above, without introduction of any substantial hydraulic ripple.

The ring valve of the present invention has several characteristics which cooperate in a synergistic way to provide a much tighter porting surface seal both initially in the manufactured product and over a long working life of the valve, as compared to the conventional kidney valve.

One such characteristic is that the symmetrical geometry of annular ring seat surface 120 and annular cluster of cylinder port holes 80 lends itself particularly well to flat lapping in production, for provision of an optimum face-to-face seal. Another such characteristic is that the symmetrical geometry and narrow angles of attack and departure of cylinder port face 52 and cylinder ports 80 relative to the inner and outer edges 122 and 126, respectively, of ring seat surface 120 cause a self-cleaning action and a continuous micro-surface lapping which maintains an accurate flatness of the mating surfaces as the valve wears over a long operational life. With this action, there is no tendency whatsoever for grooving to occur, and the original tight, generally leak-proof seal is maintained over the long operational life.

Another very important characteristic which cooperates with the others in the provision of a tight porting seal is that the geometry of the eccentric ring seat surface 120 and annular cluster of cylinder ports 80 enables the valving surfaces to be much smaller in area, with a consequently much smaller periphery, than the conventional kidney valve. This smaller size enables more accurate flatness to be manufactured and maintained in the mating porting surfaces. The more accurate flatness enables the mating valve surfaces to be closer together in their surface-to-surface direction, or in the direction normal to the surfaces, minimizing the escape path in this normal or axial direction of the valve, while the reduced perimeter enabled by the smaller valving surfaces reduces the fluid escape path in the direction parallel to the flat surfaces, or in the general radial direction of the valve. Also, the smaller radius of the portion of the rotating cylinder port face 52 which engages ring seat surface 120 results in reduced scrubbing velocity, which is proportional to radius, and therefore reduced wear.

The velocity of the portion of cylinder block port face 52 which faces against ring seat surface 120 is actually very low in absolute terms. Thus, in prototypes of the present invention developed for the purpose of fuel injection pumping, the seal ring seat surface outer diameter was approximately one inch, with an eccentricity of approximately 3/16 inch. This results in the diameter of cylinder block port face 52 which sweeps against ring seat surface 120 being approximately 11/8 inch which, multiplied by pi (3.14) gives an outer periphery of the sweeping surface of approximately 4.32 inch. For a typical diesel engine rpm of 2,400, with the ring valve pump 10 being crank-driven, which is typically the case, the outer peripheral speed of the sweeping surface is approximately 14.4 feet per second, with an average speed of port face surface 52 which sweeps ring seat surface 120 that is considerably less than 14.4 feet per second.

An extremely important advantage of the invention results from the very low leakage achieved with the ring valve porting of the present invention. This is the ability of ring valve pump 10 of the invention to build up to full operating output pressure at very low rpm. This is very important where the pump is engine-driven, which is preferably at crankshaft speed, but may be at camshaft speed, or may be at any other desired speed through a belt, gear or shaft drive. Where ring valve pump 10 is employed to pump pressurized fuel to fuel injectors, it is absolutely essential that the pump 10 be capable of providing substantially full pressure at engine starting speeds, which are very low. Sealing of the present ring valve porting is so volumetrically very tight that full pressure has been achieved with prototypes of the present ring valve pump at engine speeds under 70 rpm, as compared to in excess of 300 rpm normally required with conventional rotating cylinder block fuel injector pumps which have kidney valve porting. This is a better than four-to-one start-up advantage for the present invention, which indicates a new order of magnitude of port sealing advantage for the present invention.

Ring valve element 110 and the portion of cylinder block port face 52 exposed to inlet chamber 128 are immersed in the fluid being pumped. Additionally, a thin film of the fluid, only a few molecules in thickness, continuously works its way in between the opposed porting faces, ring seat surface 120 and that portion of cylinder port face 52 which registers with ring seat surface 120 during rotation of the cylinder block. This thin film of fluid between the porting faces serves to lubricate the faces against wear. This thin fluid film is actually pumped into the interface between the porting surfaces by the high fluid pressure within output port 122 of ring valve element 110 and in those cylinder ports 80 receiving pressurized fluid from their respective cylinders, these being cylinder ports **80*b*, 80*c* and 80*e* in FIG. 6. This pressurized fluid in the interface gradually works its way out from between the porting surfaces, but at such a slow rate as to not represent any material amount of fluid leakage. This pressurized fluid in the porting surface interface produces a lift-off force which tends to lift ring seat surface 120 axially off of cylinder port face 52. The lift-off pressure pattern is approximately shown by phantom line 148 in FIG. 6A, extending radially outwardly from ring valve output port 122, and curving even further radially outwardly about the pressurized cylinder ports 80. The total lift-off force on ring valve element 110 is determined by area increments times the pressure at the increments integrated over the entire area defined within the lift-off pressure pattern 148. The lift-off pressure pattern 148 will continuously vary as the pressurized cylinder ports 80 rotate, and the extent of the lift-off force will slightly vary with such variations in the lift-off pattern 148. This lift-off force at its worst condition is more than counterbalanced by a hold-down force of output fluid pressure in cylindrical recess 114 of end housing 120 against ring valve element 110. This hold-down force is determined by the output fluid pressure times the cross-sectional area of valve element cylindrical body 112 from an inner radius defined by output port 122 and an outer radius defined by the outer periphery of O-ring seal 116**.

Figure 6A:
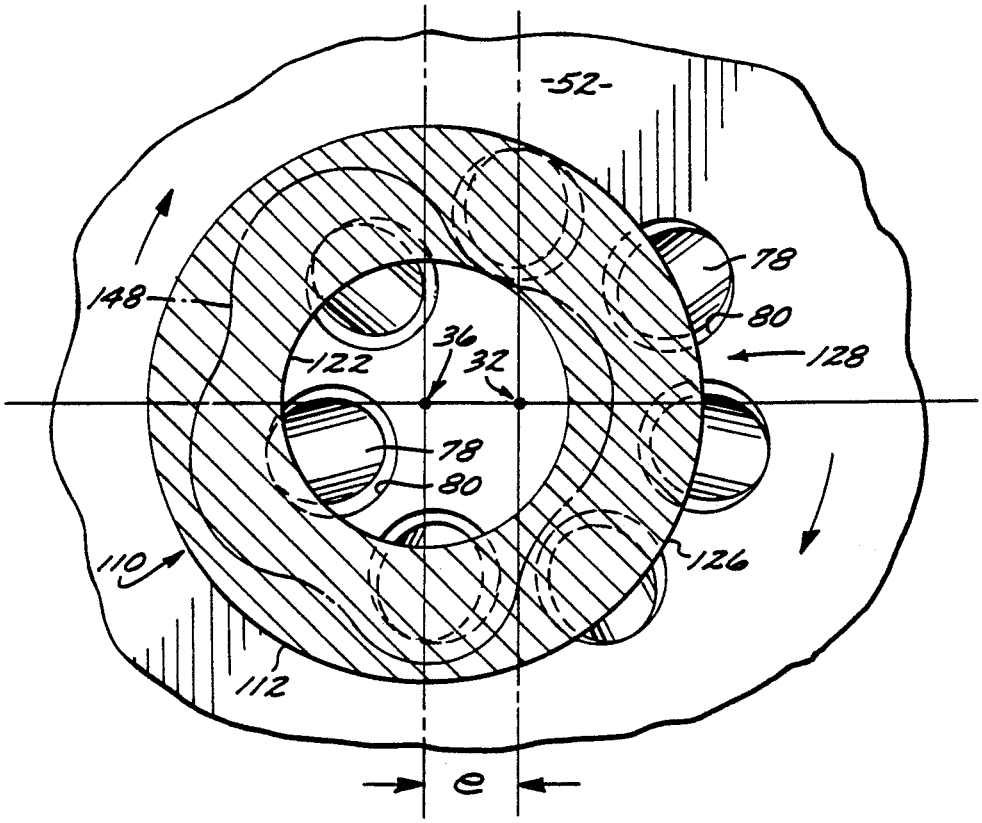
Figure 7:
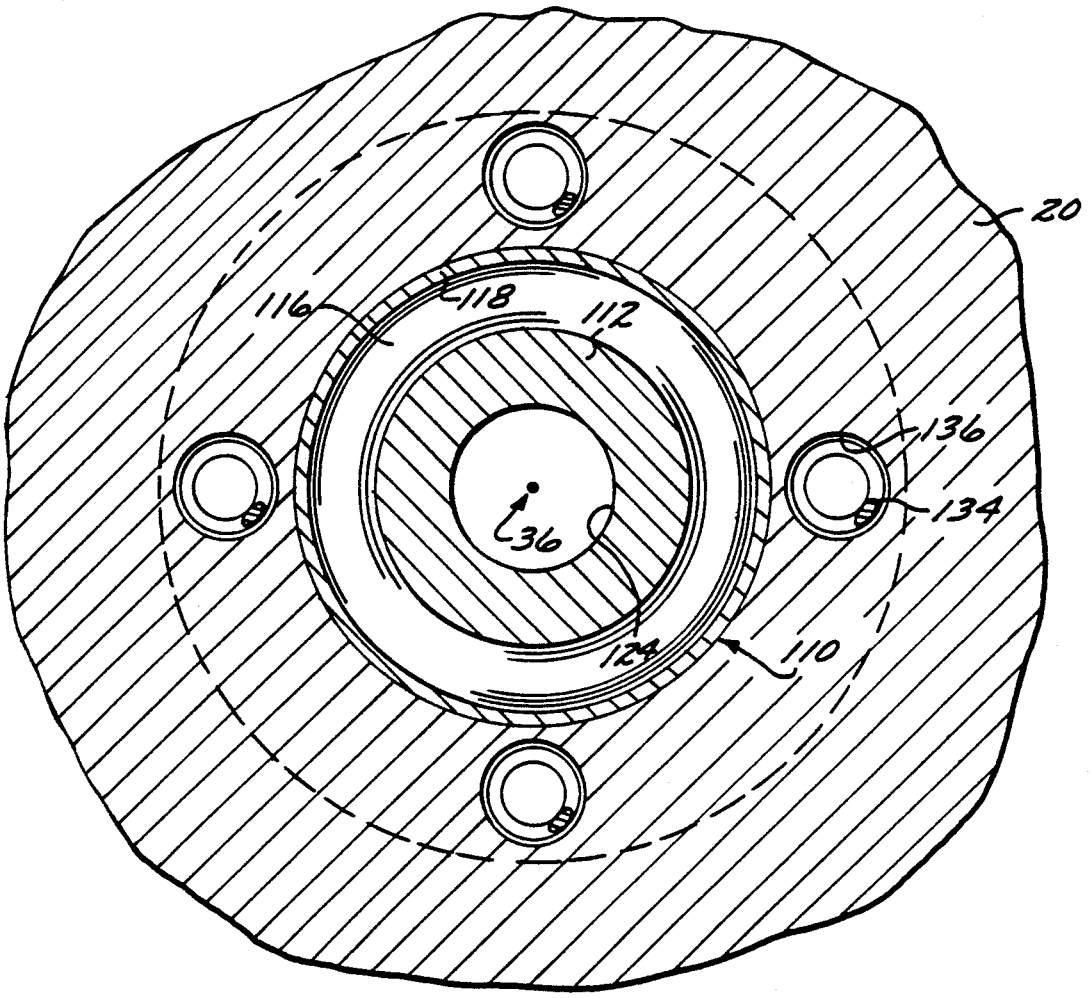
FIG. 7 is an enlarged, fragmentary transverse sectional view taken on the line 7—7 in FIG. 4.

While phantom line 148 in FIG. 6A generally defines the lift-off pressure and force pattern, it is to be understood that the pressure and force per incremental area are at a maximum proximate output port 122 and the pressurized cylinder ports 80, and diminish radially outwardly therefrom generally to the pattern line 148. Nevertheless, it is to be understood that the entire interface between ring seat surface 120 and the registering portion of cylinder port face 52 is lubricated by a thin film of the fluid being pumped.

The fluid pressure hold-down force on valve element 110 is made sufficient around the entire annular extent of ring valve element 110 to provide firm seating of ring seat surface 120 against cylinder port face 52, despite the irregularities of the lift-off pressure pattern 148 about the ring seat center which is the eccentric center 36. Although this may cause somewhat more force to be applied between the valving surfaces on one side of ring seat 120 than the other, this has not been found to provide any appreciably greater wear on the side having the greater force application, particularly in view of the lubricating film between the valving surfaces, and with the very low wiping speed of one surface against the other. The presence of slipper ring 118 around O-ring seal 116 provides ring valve element 110 with full freedom of axial movement for micro-adjustment of ring seat surface 120 against cylinder block port face 52 for assurance of an optimum seal between these porting faces.

While the present invention has been described herein with reference to presently preferred embodiments, it is to be understood that various modifications may be made by those skilled in the art without departing from the scope and spirit of the invention as set forth in the appended claims.

I claim:

1. A hydraulic pump which comprises:

a body having generally opposite first and second ends;

a drive shaft entering said body through said first end;

inlet and output flow passage defined by said body proximate said second end;

a cylinder block rotatable within said body and operatively connected to said shaft so as to be rotatably driven by said shaft, said cylinder block having an annular array of regularly spaced cylinders and a piston axially slideable in each of said cylinder;

means within said body engageable with said pistons for moving said pistons in regular succession through compression strokes and suction strokes in their respective cylinders, with the pistons orbiting through a first 180° sector of the body moving in compression strokes and the pistons orbiting through a second 180° sector of the body moving in suction strokes;

a cylinder port face on said cylinder block which is generally radially oriented relative to the axis of rotation of said cylinder block;

a plurality of regularly spaced cylinder ports in said cylinder port face, said cylinder ports corresponding in number to said cylinders and being annularly arrayed about said axis of rotation, each of said cylinder ports communicating with a respective one of said cylinders, a valve element in said body having a generally ring-shaped, substantially annular valve seat surface which is complementary to and seats against said cylinder port face, the axis of said seat being eccentrically offset toward one of said 180° sectors of the body relative to said axis of rotation;

said valve seat surface having a substantially circular inner edge defining an inner port which communicates with one of said body passages and a substantially circular outer edge defining an outer port which communicates with the other of said body passages;

said cylinder ports which communicate with the cylinders orbiting through said one 180° sector of the body toward which said seat axis is offset being exposed to said inner port, and said cylinder ports which communicate with the cylinders orbiting through the other said 180° sector of said body being exposed to said outer port.

2. A hydraulic pump as defined in claim 1, wherein said cylinder port face and said valve seat surface are substantially flat.

3. A valve port system as defined in claim 1, wherein said piston moving means causes said pistons to move along a generally sinusoidal path as they orbit through said first and second 180° sectors of said body, and the area of each of said cylinder ports that is uncovered at said inner and outer ports varies generally in accordance with such piston movement so that the fluid flow paths through said valve port system are generally compatible with the flow volumes generated by the piston movements, whereby hydraulic ripple is minimized in fluid delivered by said valve port system to said body output passage.

4. A valve port system as defined in claim 3, wherein said piston moving means comprises swash plate means.

5. A hydraulic pump as defined in claim 1, wherein said inner port communicates with said output flow passage and said outer port communicates with said inlet flow passage, and wherein said seat axis is eccentrically offset toward said first 180° sector of the body, whereby said inner port is an outlet port which receives a flow of pressurized fluid from the compression stroke cylinders and delivers it to said output passage, and said outer port is an inlet port which receives a flow of fluid from said inlet passage and delivers it to the suction stroke cylinders.

6. A hydraulic pump as defined in claim 5, wherein said valve element is located in an end housing of said body.

7. A valve port system as defined in claim 5, wherein said piston moving means causes said pistons to move along a generally sinusoidal path as they orbit through said first and second 180° sectors of said body, and the area of each of said cylinder ports that is uncovered at said inner and outer ports varies generally in accordance with such piston movement so that the fluid flow paths through said valve port system are generally compatible with the flow volumes generated by the piston movements, whereby hydraulic ripple is minimized in fluid delivered by said valve port system to said body output passage.

8. A valve port system as defined in claim 7, wherein said piston moving means comprises swash plate means.

9. A hydraulic pump as defined in claim 5, wherein said valve element comprises a generally cylindrical structure that is generally coaxial with said seat axis, and said body has a generally cylindrical cavity therein which is also generally coaxial with said seat axis and which communicates with said body output flow passage, said structure being generally coaxially mounted in said cavity;

said structure having a generally axial fluid output conduit therethrough which communicates at one end with said output port and the other end with said cavity so as to establish communication between said output port and said body output flow passage.

10. A hydraulic pump as defined in claim 9, wherein said valve element is located in an end housing comprising said second end of said body.

11. A hydraulic pump as defined in claim 9, which comprises a generally annular inlet chamber generally radially surrounding said outer port so as to provide communication between said outer port and said body inlet passage.

12. A hydraulic pump as defined in claim 9, which comprises stop means engageable between said body and said valve element for preventing rotation of said valve element relative to said body.

13. A hydraulic pump as defined in claim 9, which comprises hold-down biasing means in said body for biasing said valve element toward said cylinder port face so as to hold said valve seat surface down against said cylinder port face.

14. A hydraulic pump as defined in claim 13, wherein said hold-down biasing means comprises output fluid pressure in said cavity operating against the cross-section of said structure.

15. A hydraulic pump as defined in claim 14, wherein the hold-down force of said hold-down biasing means is sufficient to more than counterbalance the lift-off force of hydraulic fluid which works into the interface between said cylinder port face and said valve seat surface from said inner port and said cylinder ports which are in communication with said inner port.

16. A valve port system as defined in claim 15, which comprises start-up spring biasing means in said body engaged against said valve element for biasing said valve element toward said cylinder port face so as to hold said valve seat surface down against said cylinder port face during start-up of said pump before said fluid pressure hold-down biasing means is sufficient to perform such hold-down function.

* * * * *